US005241976A

United States Patent [19]

Ikawa

[11] Patent Number: 5,241,976

[45] Date of Patent: Sep. 7, 1993

[54] CLEANING EQUIPMENT

[75] Inventor: Reiji Ikawa, Tokyo, Japan

[73] Assignee: Tokyo Special Wire Netting Co. Ltd., Tokyo, Japan

[21] Appl. No.: 781,695

[22] Filed: Oct. 23, 1991

[30] Foreign Application Priority Data

Oct. 23, 1990 [JP] Japan ..... 2-285656

[51] Int. Cl.[5] ..... B08B 3/00

[52] U.S. Cl. ..... 134/61; 134/108

[58] Field of Search ..... 134/61, 66, 67, 68, 134/72, 73, 74, 76, 77, 83, 105, 108, 109

[56] References Cited

U.S. PATENT DOCUMENTS

| | | | |
|---|---|---|---|
| 2,028,759 | 1/1936 | Dinley | 134/74 X |
| 3,144,872 | 8/1964 | Kearney | 134/72 |
| 4,240,453 | 12/1980 | Vial et al. | 134/109 X |
| 4,589,926 | 5/1986 | Holmstrand | 134/72 X |
| 4,612,712 | 9/1986 | Pescatore et al. | 134/105 X |
| 5,045,120 | 9/1991 | Mittag et al. | 134/73 X |
| 5,113,882 | 5/1992 | Gileta | 134/73 X |
| 5,143,103 | 9/1992 | Basso et al. | 134/105 X |

*Primary Examiner*—Philip R. Coe
*Attorney, Agent, or Firm*—Varndell Legal Group

[57] ABSTRACT

In cleaning equipment for cleaning articles to be cleaned such as electric parts, electronic parts, machine parts, optical related parts, resin processed articles, printing screens or the like, cleaning using flammable solvent is made possible, and it is possible to maintain concentration of the cleaning solvent and to prevent the cleaning solvent from being contaminated. Thus, the cleaning is conducted at a low operation cost. For this purpose, any one of steam, steam and nitrogen, and steam and carbon dioxide is supplied to an inlet pass-box and an outlet pass-box for the articles to be cleaned. A cleaning chamber and a distillation column are arranged within the cleaning equipment. A condenser of the distillation column is connected to the cleaning chamber.

20 Claims, 4 Drawing Sheets

CLEANING EQUIPMENT

BACKGROUND OF THE INVENTION

1. Field of the Invention

The present invention relates to equipment for cleaning articles to be cleaned such as electric parts, electronic parts, machine parts, optical related parts, resin processed articles, printing screens or the like, by the use of flammable solvent.

2. Description of the Prior Art

Conventionally, in the case where articles to be cleaned such as electric parts, electronic parts, machine parts, optical related parts, resin processed articles, printing screens or the like are cleaned, it has been common to use halogenated organic compounds such as CFC (Chloro Fluoro Carbon), trichloroethane and the like, which are nonflammable.

It has been found, however, that these inflammable solvents are harmful to the global environment as such represented by depletion of the ozone layer or the like. It is becoming difficult to use such chemicals as cleaning solvents hereafter.

As cleaning chemicals in place of these nonflammable solvents, there exist flammable solvents, for example, alcohols such as methanol, ethanol, isopropyl alcohol and the like, ketones such as acetone, methyl ethyl ketone, methyl isobutyl ketone and the like, or petroleum fractions such as benzene, toluene, xylene, naphtha, kerosene or the like. Although these flammable solvents have a superior cleanability, they are generally volatile and are easily ignitable. Thus, it often leads to a disaster brought by a fire, an explosion and the like, if these flammable solvents are used in the cleaning equipment.

For this reason, in order to conduct the cleaning by the use of the aforesaid flammable solvents, it is necessary to prevent the equipment from attaining a condition in which combustion of these solvents is made possible, by the fact that the communication of gas between the cleaning atmosphere within the cleaning equipment and the outside air is cut off, by the fact that, even if air leaks into the equipment, the air is selectively discharged to the outside of the system, or the like.

However, there are no economical and reliable techniques to prevent from attaining the said condition. Thus, until now, it has been practically difficult to unitize the flammable solvents for cleaning the articles to be cleaned.

Further, in order to remove unnecessary solid materials which are contained in the solvent as the result of the cleaning, it has been common to use a method in which the cleaning solvent recirculated by pump passes through a filter to date. However, the method is complicated mechanically, and it is difficult to remove contaminant components dissolved in the cleaning solvent.

Furthermore, the conventional cleaning equipment has no function to discharge only the contaminant components to the outside of the equipment while the cleaning solvent is kept confined within the equipment, even if a distillation apparatus is provided in which the cleaning solvent contaminated in the course of cleaning is regenerated by distillation. Accordingly, it is required that the equipment is halted and the used solvent is replaced with new solvent eventually.

For the reasons discussed above, the expenses for treating the used solvent and also for purchasing the new solvent are required so that not only the running cost increases, but also there is a possibility that treatment of the used solvent may cause an environmental problem with the conventional equipment.

SUMMARY OF THE INVENTION

The invention intends to solve the above-discussed problems, and it is an object of the invention to provide a cleaning equipment for cleaning articles to be cleaned such as electric parts, electronic parts, machine parts, optical related parts, resin processed articles, printing screens or the like, in which relative air concentration of the cleaning atmosphere is reduced, and attainment of the condition in which combustion of flammable solvent is made possible is always prevented perfectly or completely, whereby the use of flammable solvents is made possible in place of nonflammable solvents such as CFC (Chloro Fluoro Carbon), trichloroethane or the like, wherein only contaminant components in the cleaning solvent flow out of the distillation column together with condensed water while performing the separation between cleaning solvent and water by distillation, and wherein it is made possible to maintain concentration of the cleaning solvent and to prevent the cleaning solvent from being contaminated, so that the cleaning is conducted at a low running cost.

In order to solve the above-discussed problems, according to the invention, there is provided cleaning equipment in which any one of steam, steam and nitrogen, and steam and carbon dioxide is supplied to the inlet pass-box for introducing the articles to be cleaned and the outlet pass-box for taking out the articles to be cleaned completed in cleaning, in which the communication of gas between the cleaning atmosphere and the outside air is cut off by any one of steam, steam and nitrogen, and steam and carbon dioxide, in which a cleaning chamber using a flammable solvent lower in boiling point than water and a distillation column for separating water and the flammable solvent from each other are arranged at a location between the inlet pass-box and the outlet pass-box, in which the condenser of the distillation column is connected to the cleaning chamber, in which condensed liquid from the condenser can be refluxed into the distillation column through the cleaning chamber, and in which contaminant components removed from the articles to be cleaned are discharged to the outside of the equipment system together with condensed water separated from the flammable solvent by the distillation.

According to the invention, there is further provided cleaning equipment in which any one of steam, steam and nitrogen, and steam and carbon dioxide is supplied to a pass-box through which articles to be cleaned are conveyed to and from, in which the communication of gas between cleaning atmosphere and the outside air is cut off by any one of steam, steam and nitrogen, and steam and carbon dioxide, in which a cleaning chamber using a flammable solvent lower in boiling point than water and a distillation column for separating water and the flammable solvent from each other are connected following after the pass-box, and in which the condenser of the distillation column is connected to the cleaning chamber, in which condensed liquid from the condenser can be refluxed into the distillation column through the cleaning chamber, and in which contaminant components removed from the articles to be cleaned are discharged to the outside of the equipment system together with condensed water separated from the flammable solvent by the distillation.

The above and other objects and features of the present invention will become more apparent when referred to the following descriptions in conjunction with the accompanying drawings.

DESCRIPTION OF THE PREFERRED EMBODIMENTS

Figure 1:
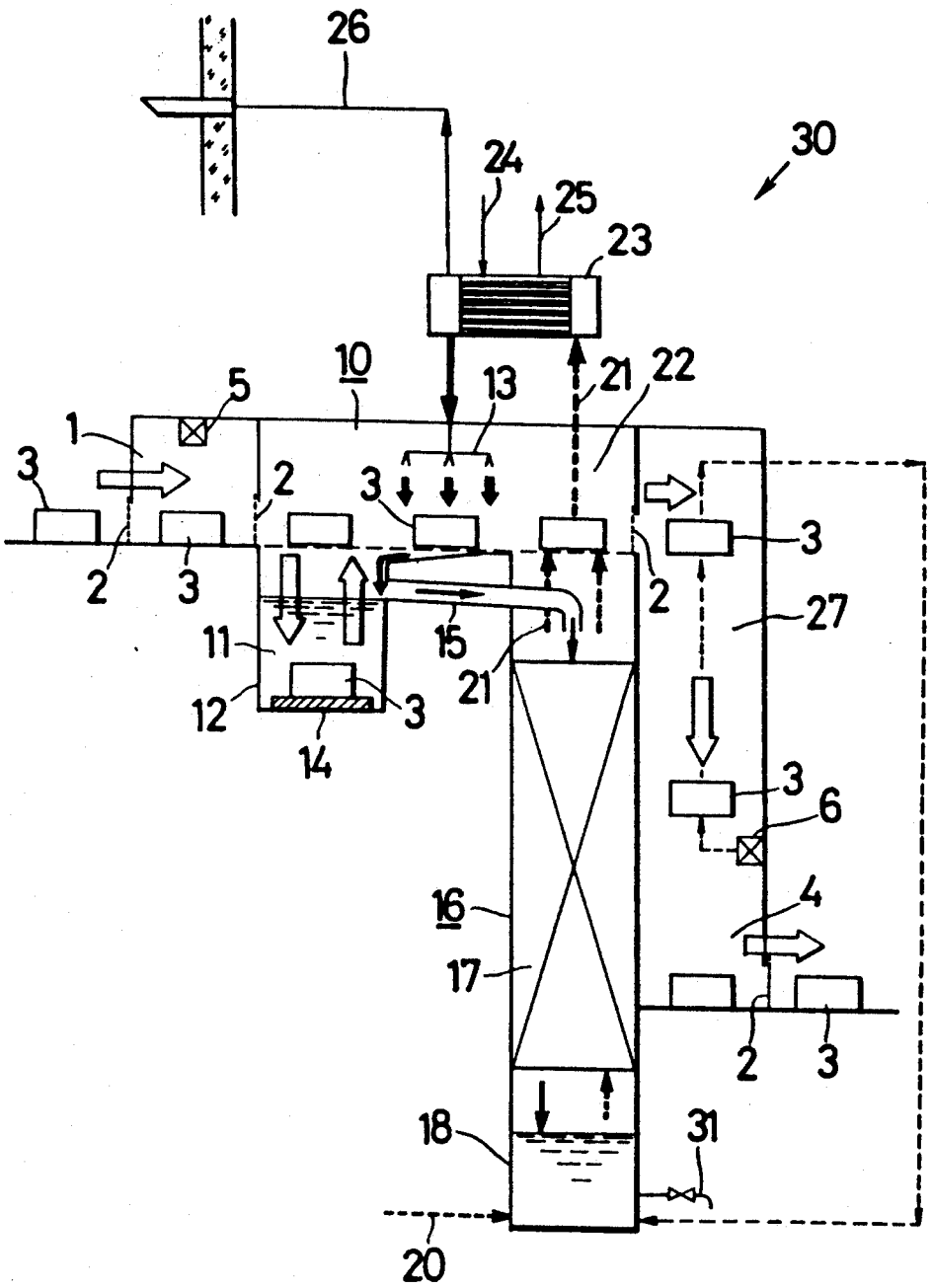
FIG. 1 is a conceptional view of a first embodiment according to the invention.

A first embodiment according to the invention will be described below with reference to FIG. 1. An inlet pass box 1 allows a plurality of articles to be cleaned 3 contained in a basket to pass through a first one of a plurality of shutters 2. A pair of injection nozzles 5 and 6 are arranged respectively at the inlet pass-box 1 and the outlet pass-box 4 through which the articles to be cleaned 3 are taken out after completion of the cleaning. Any one of steam, steam and nitrogen, and steam and carbon dioxide can be supplied to the injection nozzle 5. Further, any one of steam, steam and nitrogen, and steam and carbon dioxide can also be supplied to the injection nozzle 6. Any one of steam, steam and nitrogen, and steam and carbon dioxide is injected through each of the injection nozzle 5 and 6, whereby the communication of gas between the cleaning atmosphere and the outside air can be out off.

Furthermore, a cleaning chamber 10, in which a flammable solvent lower in boiling point than water is used, is placed between the inlet pass-box 1 and the outlet pass-box 4. The cleaning chamber 10 may be formed only by a liquid cleaning tank 12 containing aqueous flammable solvent 11 in which the articles to be cleaned 3 are soaked. Alternatively, the cleaning chamber 10 may be formed only by a plurality of shower nozzles 13 which performs shower cleaning of the articles to be cleaned 3. As shown in FIG. 1, however, the cleaning chamber 10 is formed by both the liquid cleaning tank 12 to submerge and soak the articles to be cleaned 3 and the shower nozzles 13 to do shower cleaning of the articles to be cleaned 3. Thus, effective liquid cleaning of the articles to be cleaned 3 is made possible. Moreover, an ultrasonic oscillator 14 is arranged within the liquid cleaning tank 12 of the cleaning chamber 10 so as to enable to do ultrasonic-cleaning the articles to be cleaned 3.

Further, the distillation column 16 is connected to the liquid cleaning tank 12 of the cleaning chamber 10 through a liquid line 15 for the aqueous flammable solvent 11, to enable the aqueous flammable solvent 11 contaminated in the cleaning chamber 10 to be introduced into the distillation column 16. Furthermore, water is present in the aqueous flammable solvent 11 due to the condensed water from the steam supplied form the outside. Moreover, the distillation column 16 is formed with a gas-liquid contact layer 17 executing gas-liquid contact between the vapor consisting of water and the flammable solvent and the liquid whose components are the same as those of the vapor, and a heater section 18 is provided for heating the liquid accumulated at the bottom of the distillation column 16. Stripping steam 20 is introduced into the heating section 18 to evaporate a part of the liquid accumulated at the heating section 18.

Further, the rising vapor from the heating section 18 and the liquid flowing downward within the distillation column 16 are made in gas-liquid contact with each other to enable separation of the condensed water and regeneration of concentrated solvent vapor 21 whose main component is flammable solvent.

Furthermore, the distillation column 16 has a top which is connected to a vapor cleaning zone 22 which is formed in the cleaning chamber 10. In the vapor cleaning zone 22, the articles to be cleaned 3 completed in the aforesaid shower cleaning can be vapor-cleaned by the concentrated solvent vapor 21.

Moreover, the distillation column 16 has a condenser 23 which is connected to the vapor cleaning zone 22. The concentrated solvent vapor 21 containing slight air, or steam, steam and nitrogen, or steam and carbon dioxide mixed at the vapor cleaning zone 22, can be introduced into the condenser 23. In order to condense the concentrated solvent vapor 21 from the vapor cleaning zone 22, the condenser 23 is provided with the cooling water inlet 24 and the cooling water outlet 25 for the recirculation of cooling water. Moveover, the condenser 23 is connected to the shower nozzles 13 in the cleaning chamber 10 to enable the aqueous flammable solvent 11 to be refluxed into the distillation column 16 through the cleaning chamber 10.

Further, a vent line 26, which is so provided as to be extended to the outdoor, is connected to the condenser 23. Non-condensable gas accumulated in the condenser 23 is discharged outside through the vent line 26, whereby air which enters the equipment can always be discharged to the outside of the system.

Furthermore, a dryer zone 27 for the articles to be cleaned 3 is installed between the vapor cleaning zone 22 and the outlet pass-box 4. The dryer zone 27 is arranged such that, in order to serve both as cutting-off the communication of gas with the outside air and as thermal drying, steam, steam and nitrogen, or steam and carbon dioxide supplied to the outlet pass-box 4, is/are introduced into the dryer zone 27. Thus, the dryer zone 27 serves as a dryer heat source for the articles to be cleaned 3. The steam, steam and nitrogen, steam and carbon dioxide used in the drying is/are introduced into the heating section 18 of the distillation column 16 and is/are used as a part of the stripping steam 20, so that energy saving to operate the distillation column 16 is made possible.

Furthermore, a plurality of shutters 2, which are remained closed at any time other than passage of the articles to be cleaned 3, are arranged respectively at the inlet pass-box 1, the cleaning chamber 10, the dryer zone 27 and the outlet pass-box 4. Under the condition that the shutters 2 are closed, it is made possible to prevent the outside air from being invaded and to prevent the vapor within the cleaning atmosphere from fleeing.

Moreover, as moving means for the articles to be cleaned 3 from the inlet pass-box 1 to the outlet pass-box 4, it is possible to use a horizontal conveying unit such as a belt conveyor, a chain conveyor, a roller conveyor or the like, and a vertical conveying unit such as a vertical conveyor, a lifter or the like. In this manner, it is possible to select any optional moving means as the above-described moving means.

In the arrangement constructed as described above, in order to clean the articles to be cleaned 3 such as electric parts, electronic parts, machine parts, optical related parts, resin processed articles, printing screens or the like, the articles to be cleaned 3 are led into the cleaning chamber 10 through the inlet pass-box 1.

Any one of steam, steam and nitrogen, and steam and carbon dioxide, which cuts off the communication of gas between the outside and the cleaning atmosphere within the cleaning equipment 30, is supplied to the inlet pass-box 1 through which the articles to be cleaned 3 pass at carrying-into thereof and to the outlet pass-box 4 through which the articles to be cleaned 3 pass at taking-away thereof. For this reason, even at carrying-into and taking-away of the articles to be cleaned 3, it is possible to prevent the outside air from being invaded into the cleaning equipment 30 and to prevent the gas containing the flammable solvent from being flowing out to the outside. Thus, even if air leaks into the interior of the cleaning equipment 30, a partial pressure of the air is reduced. Further, by discharge of air to the outside of the system by way of the condenser 23 of the distillation column 16, a condition in which combustion of the flammable solvent is made possible is prevented from being attained, making it possible to prevent dangers of such as a fire, an explosion and the like, at low cost.

Cleaning of the articles to be cleaned 3 introduced into the cleaning chamber 10 is next performed. First, the articles to be cleaned 3 are submerged in the liquid cleaning tank 12 to conduct soaking of the articles to be cleaned 3 and to perform ultrasonic vibration by the ultrasonic oscillator 14. Then, the articles to be cleaned 3 are moved to a location under the shower nozzles 13 to perform shower cleaning with the aqueous flammable solvent 11 flowing out of the shower nozzles 13.

These cleanings use the flammable solvent. As the flammable solvent, however, alcohols such as methanol, ethanol, isopropyl alcohol and the like, ketones such as acetone, methyl ethyl ketone and the like, or petroleum fractions such as benzene, which are lower in boiling point than water, may be used independently. Alternatively, these flammable solvents are not used independently, but a plurality of kinds of flammable solvents may be used. Further, the steam is supplied from the outside, whereby the flammable solvent is used in the form containing a small quantity of water as condensate from steam.

After the liquid cleaning has been conducted with the aqueous flammable solvent 11, the articles to be cleaned 3 are moved to the vapor cleaning zone 22.

Furthermore, the aqueous flammable solvent 11, which has been used and contaminated in the liquid cleaning, is required to separate a part of water in order to prevent the solvent concentration from being reduced by the increase of water due to the condensation of steam with the elapse of time. For this reason, the aqueous flammable solvent 11 is introduced into the distillation column 16 through the liquid line 15 to conduct removal of the condensed water and concentration of the solvent by distillation.

Within the distillation column 16, rising vapor generated at the heating section 18 and falling liquid are in gas-liquid contact with each other at the gas-liquid contact layer 17. By the gas-liquid contact, mass transfer between vapor and liquid occurs due to a difference in boiling point between the flammable solvent and water. The concentrated solvent vapor 21, which is concentrated by the mass transfer of the flammable solvent, exists at the top of the distillation column 16. Furthermore, at the bottom of the distillation column 16, the condensed water separated exists. Moreover, there is a possibility that a small quantity of flammable solvent is contained in the condensed water separated. This, however, makes it possible to minimize the flammable solvent content in the separated water by the design of the distillation column 16, selection of the operating conditions and the like to such an extent that the mall-effects on the economics and the environment are nullified.

Further, solid matters and contaminant components are contained in the aqueous flammable solvent 11 used for cleaning. These solid matters and contaminant components are generally higher in boiling point than water, or are non-volatile. These solid matters and contaminant components flow downward together with the liquid through the gas-liquid contact layer 17, and are finally moved into the condensed water at the heating section 18 which is arranged at the bottom of the distillation column 16.

Furthermore, if the condensed water within the distillation column 16, is discharged to the outside through a drain pipe 31 which is connected to the heating section 18, it is possible to self-remove the solid matters, contaminant components and the like which exist in the heating section 18 together with the drainage of the condensed water.

Moreover, since these solid matters and contaminant components can easily be self-removed together with the drainage of the condensed water while concentrating the aqueous flammable solvent 11 by distillation and while confining the flammable solvent within the cleaning equipment 30, complicated apparatuses, troublesome or cumbersome operations and the like are not required for the removal.

Further, this removal method is conducted by the distillation column 16. For this reason, it is possible to easily conduct removal of the contaminant components dissolved in the cleaning solvent which has been difficult by conventional methods using a filter.

Furthermore, the concentrated solvent vapor 21 leaving from the top of the distillation column 16 is introduced into the vapor cleaning zone 22, and by the concentrated solvent vapor 21, vapor cleaning of the articles to be cleaned 3 within the vapor cleaning zone 22 is conducted. After the vapor cleaning, the articles to be cleaned 3 are moved to the dryer zone 27 to perform drying. Finally, the articles to be cleaned 3 are conveyed out of the cleaning equipment 30 through the outlet pass-box 4. Thus, a cleaning cycle of the articles to be cleaned 3 is completed.

Moreover, the concentrated solvent vapor 21 used in vapor cleaning is introduced into the condenser 23 of the distillation column 16 together with steam, steam and nitrogen, or steam and carbon dioxide, supplied to the inlet pass-box 1 and the outlet pass-box 4, and together with air invaded from the outside during the conveyance of the article to be cleaned 3 to and from the condenser 23. The concentrated solvent vapor 21 is cooled and condensed, except for non-condensable gas, by cooling water of the condenser 23. Thus, The concentrated solvent vapor 21 is regenerated into the aqueous flammable solvent 11. The regenerated aqueous flammable solvent 11 flows out of the shower nozzles 13 of the cleaning chamber 10 to conduct shower cleaning of the articles to be cleaned 3. After the shower cleaning, the aqueous flammable solvent 11 is collected into the liquid cleaning tank 12. The collected aqueous flammable solvent is again refluxed into the distillation column 16.

Further, parts of the steam supplied to the inlet pass-box 1 and the outlet pass-box 4 are not led into the condenser 23, but are directly condensed within the cleaning chamber 10 and are mixed with the aqueous flammable solvent 11. Accordingly, concentration of the flammable solvent in the liquid cleaning tank 12 is diluted as compared with the condensed liquid from the condenser 23.

In this manner, the arrangement is such that the aqueous flammable solvent 11, which is used for cleaning, is introduced into the distillation column 16 or the condenser 23, so as to be regenerated into the flammable solvent which is clean and which is maintained at predetermined concentration. For this reason, it is unnecessary to wastefully disuse much of the contaminated cleaning solvent and to be replaced with new solvent, in contrast to the conventional cleaning equipment. Thus, economic cleaning is made possible. Further, since a closed system is constituted in which the used flammable solvent is not disused, but is reused, it is possible to eliminate a cause of environmental disruption.

Furthermore, even if air is invaded into the inside during the operation of the cleaning equipment 30, air introduced into the condenser 23 is not condensed together with the concentrated solvent steam 21. Accordingly, the air is dispelled through the vent line 26 of the condenser 23. Thus, it is possible to eliminate that the air is accumulated or stored within the cleaning equipment 30.

Moreover, as described above, since the vapor and the liquid of the cleaning equipment 30 flow naturally within the equipment by evaporation due to the heating section 18 of the distillation column 16 and by condensation due to the condenser 23, power such as a pump or the like is not necessarily required. Thus, economical cleaning is made possible.

Further, in the case where the flammable solvent is not required to be maintained excessively clean, if the distillation column 16 is operated intermittently, excessive distillation due to heating is prevented so that economical operation is made possible.

Figure 2:
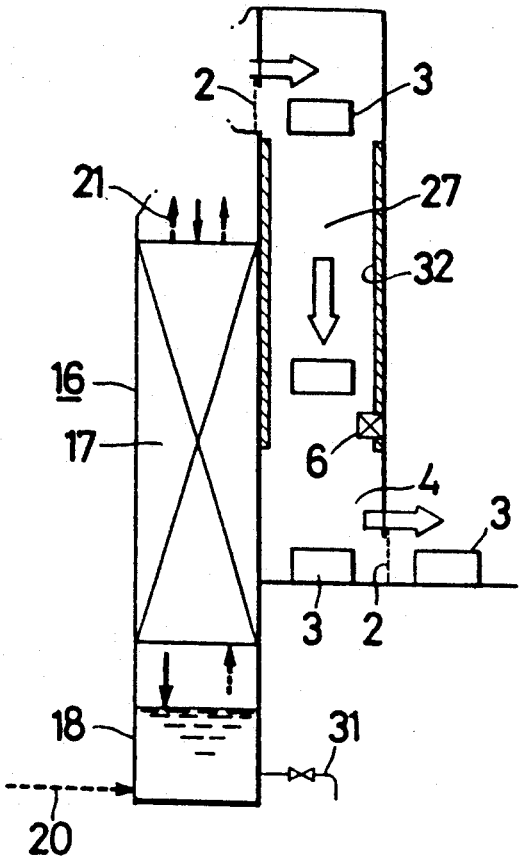
FIG. 2 is a fragmentary conceptional view showing a second embodiment according to the invention.

Furthermore, the above-described first embodiment is arranged such that the steam supplied to the outlet pass-box 4 is introduced into the dryer zone 27 so as to serve as the dryer heat source for the articles to be cleaned 3. In a second embodiment, however, as shown in FIG. 2, a heater 32, which uses steam, hot water, heated oil, an electric heater or the like, is arranged at the dryer zone 27, and serves as a dryer heat source for the articles to be cleaned 3. With the arrangement, it is possible to ensure that the articles to be cleaned 3 are dried in a short time.

Figure 3:
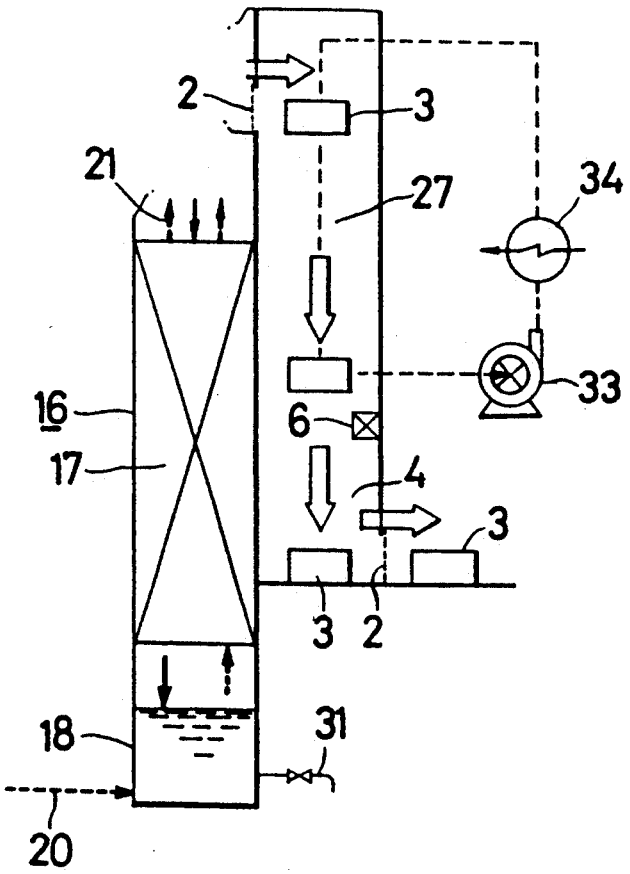
FIG. 3 is a fragmentary conceptional view showing a third embodiment according to the invention.

Moreover, the second embodiment is arranged such that the heater 32, which uses steam, hot water, heated oil, an electric heater or the like, is provided at the dryer zone 27. In a third embodiment, however, as shown in FIG. 3, a blower 33 is connected to the dryer zone 27 so as not to communicate with the outside air. By the blower 33, if gas recirculated through the dryer zone 27 is heated by a heater 34 from the outside and serves as a dryer heat source, a forced recirculating action of the dryer gas further promotes drying.

Figure 4:
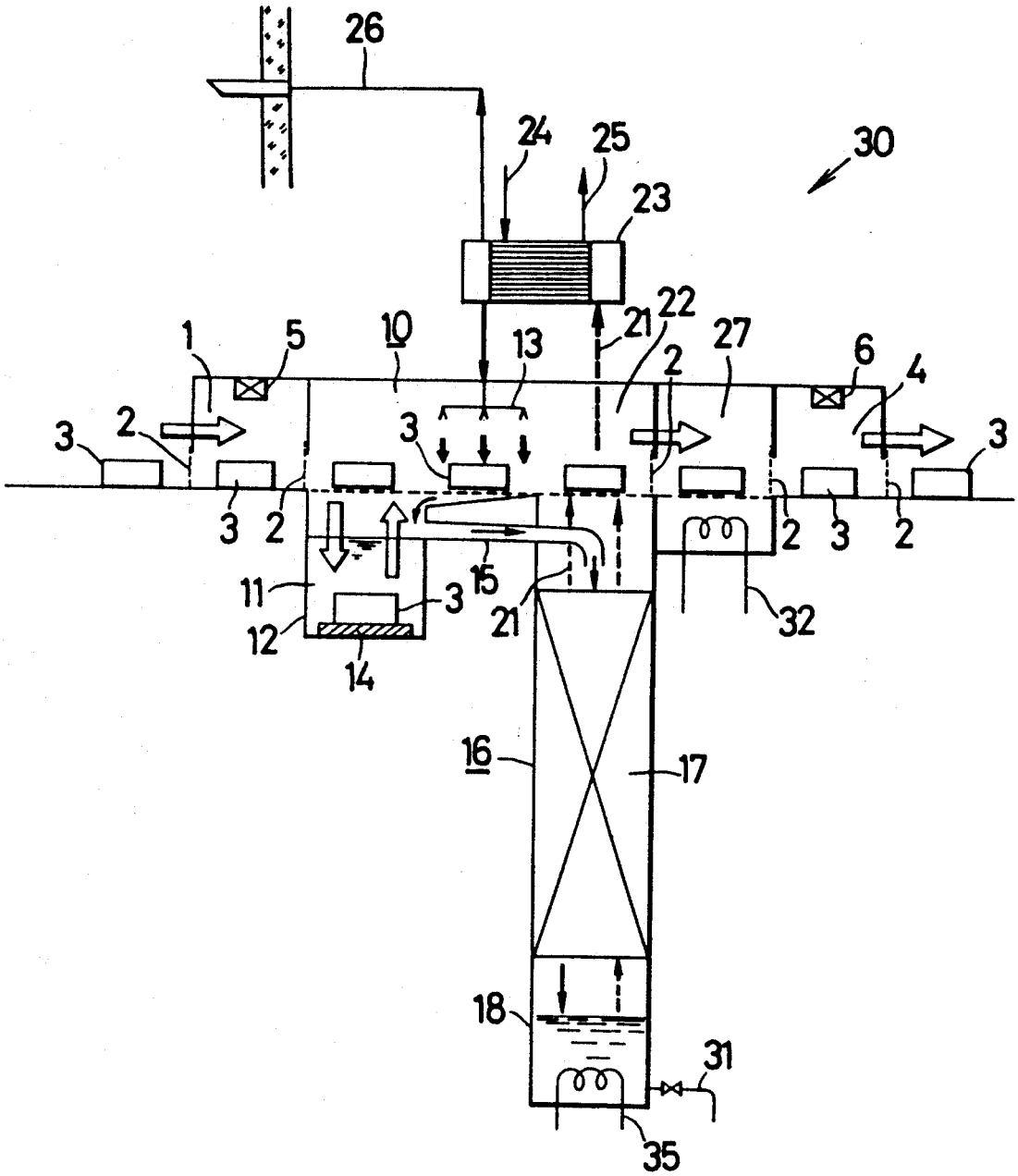
FIG. 4 is a conceptional view showing a fourth embodiment according to the invention.

Further, each of the aforementioned first, second and third embodiments is arranged such that the cleaning equipment 30 comprises both the horizontal conveying unit and the vertical conveying unit, to perform movement of the articles to be cleaned 3 in the horizontal direction and movement of the article to be cleaned 3 in the vertical direction. In a fourth embodiment, however, as shown in FIG. 4, the cleaning equipment 30 is provided only with a horizontal conveying unit except for movement to the liquid cleaning tank 12. With the arrangement, it is possible to stably move the articles to be cleaned 3, and to produce a system which is simple and low in cost. Furthermore, as illustrated in FIG. 4, the heating section 18 of the distillation column 16 is provided with a reboiler 35. With the arrangement, it is possible to reduce a drainage quantity of condensed water accumulated at the heating section 18.

Figure 5:
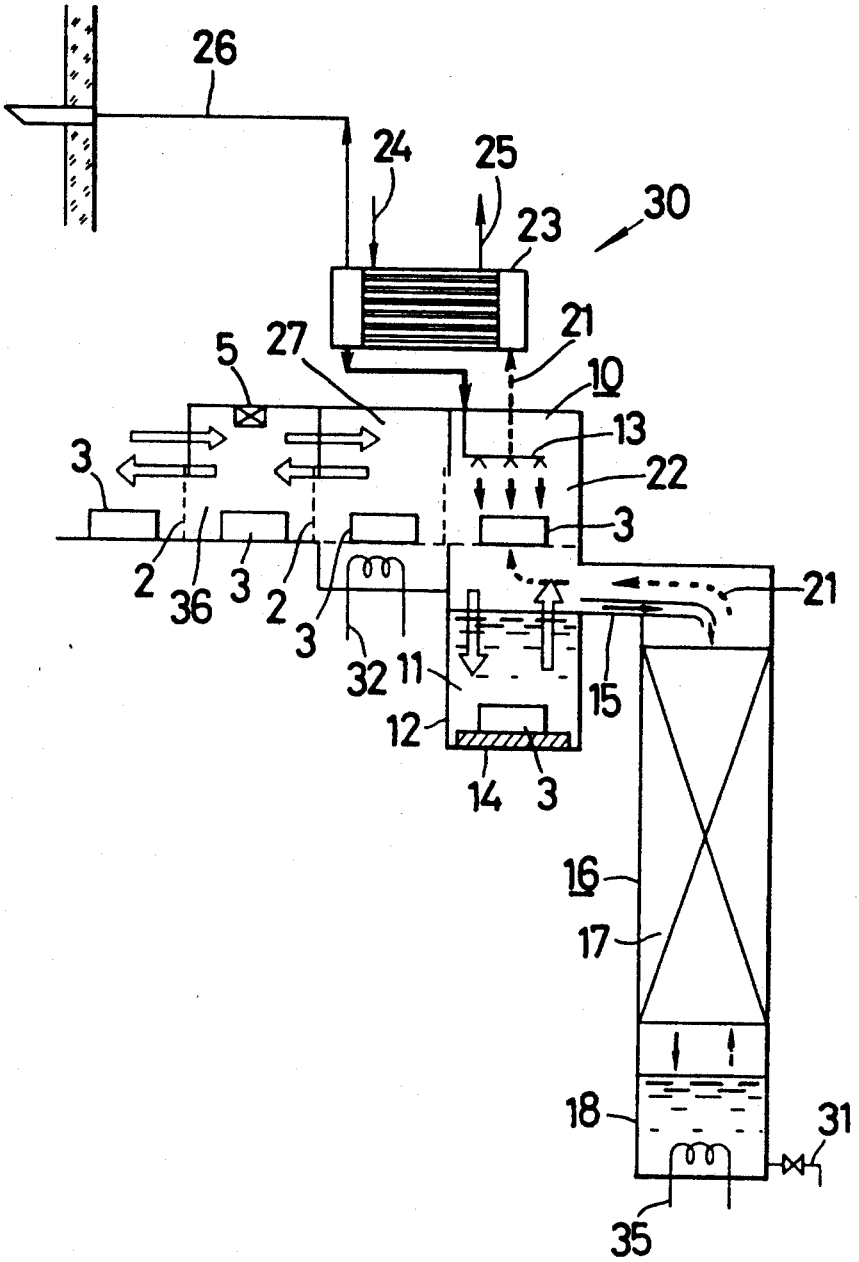
FIG. 5 is a conceptional view showing a fifth embodiment according to the invention.

Moreover, each of the aforesaid first through fourth embodiments is arranged such that, in the cleaning equipment 30, the inlet pass-box 1 for the articles to be cleaned 3 and the outlet pass-box 4 for the articles to be cleaned 3 completed in cleaning are formed separately. In a fifth embodiment, however, the cleaning equipment 30 comprises a pass-box 36 through which the articles to be cleaned 3 are carried in and taken out, as illustrated in FIG. 5. If the pass-box 36 is formed in this manner, the pass-box 36 is made simple in construction and can be manufactured at low cost as compared with the case where the inlet pass-box 1 and the outlet pass-box 4 are formed separately. Further, since the articles to be cleaned 3 are carried in and taken out only through the pass-box 36, an intensive monitoring of the equipment can be conducted in cleaning of the articles to be cleaned 3, which uses the flammable solvent. Thus, safety can be improved.

Furthermore, the dryer zone 27 for the articles to be cleaned 3 is installed between the cleaning chamber 10 and the pass-box 36, as shown in FIG. 5. With such arrangement, it is made possible to ensure that the articles to be cleaned 3 cleaned in the cleaning chamber 10 are dried quickly or speedily. For this reason, it can be eliminated that the articles to be cleaned 3 are taken out to the outside while the flammable solvent remains on the articles to be cleaned 3. Thus, it is possible to eliminate that flammable vapor of the solvent leaks to the outside.

The invention has been constructed as described above. In the cleaning equipment for cleaning the articles to be cleaned such as electric parts, electronic parts, machine parts, optical related parts, resin processed articles, printing screens or the like, steam, steam and nitrogen, or steam and carbon dioxide for cutting off the communication of gas between the cleaning atmosphere within the cleaning equipment and the outside is/are supplied to the inlet pass-box through which the articles to be cleaned pass at carrying-into thereof, and to the outlet pass-box through which the articles to be cleaned pass at taking away thereof, or to the single pass box through which the articles to be cleaned are carried in and out, and the distillation column is arranged thereat for separating the water and the flammable solvent from each other.

Accordingly, in the case where the articles to be cleaned are cleaned, it is possible to use the flammable solvent in place of nonflammable solvent such as CFC, trichloroethane or the like. Even at carrying-into and taking-away of the articles to be cleaned, the outside air is prevented from being invaded into the cleaning equipment, and the solvent vapor is prevented from fleeing to the outside. Even if the outside air is invaded into the interior, the flammable solvent can not be burned by the fact that partial pressure of the air is diluted due to existence of steam, steam and nitrogen, or steam and carbon dioxide, and the air is dispelled to the outside of the system by way of the condenser of the distillation column. Thus, it is possible to prevent dangers such as a fire, an explosion and the like.

Further, solid matters and contaminant components, which are removed by cleaning and flow downward in the distillation column, are moved to the condensed water at the bottom of the distillation column, and can easily be discharged and removed to the outside of the equipment together with drainage of the condensed water.

Since the solid matters and contaminant components can easily be removed together with drainage of the condensed water, while concentrating the flammable solvent and while confining the flammable solvent within the cleaning equipment, a complicated apparatus, troublesome and cumbersome operation and the like are not required for the removal. Furthermore, since the removal is carried out by the distillation column, it is possible to easily remove the contaminant components dissolved in the cleaning solvent, which has been difficult by the conventional method using the filter.

Moreover, the flammable solvent used for cleaning is introduced into the distillation column so as to be regenerated into the flammable solvent which is clean and maintained at the predetermined concentration. Accordingly, it is unnecessary to wastefully disuse much of the cleaning solvent, which has been contaminated and used, so as to be replaced with new solvent, dissimilarly to the conventional cleaning equipment. Thus, the cleaning at a low cost is made possible. Further, since the flammable solvent is not disused, but is reused, it is possible to eliminate a cause of environmental disruption.

Furthermore, since the vapor and the liquid naturally flow within the equipment due to evaporation at the bottom of the distillation column and due to condensation by the condenser, power such as a pump or the like is not necessarily required. Thus, economical cleaning is made possible.

What is claimed is:

1. A cleaning apparatus for cleaning articles with a flammable solvent, which comprises:

inlet means for receiving articles to be cleaned and for supplying any one of steam, steam and nitrogen, and steam and carbon dioxide and cutting off communication between a cleaning atmosphere within said cleaning apparatus and air outside of said cleaning apparatus, outlet means for discharging cleaned articles and for supplying any one of steam, steam and nitrogen, and steam and carbon dioxide and cutting off communication between a cleaning atmosphere within said cleaning apparatus and air outside of said cleaning apparatus, cleaning chamber means for contacting said articles to be cleaned with a flammable solvent having a boiling point lower than that of water, said cleaning chamber being arranged between said inlet and outlet means, and distillation column means for receiving aqueous flammable solvent from said cleaning chamber means, separating water and said flammable solvent in said aqueous flammable solvent from each other, and discharging condensed water containing contaminant components out of said cleaning apparatus, said distillation column means being arranged between said cleaning chamber means and said outlet means and including condenser means for receiving flammable solvent vapor and refluxing condensed flammable solvent into said distillation column means through said cleaning chamber means as said flammable solvent.

2. The cleaning apparatus according to claim 1, wherein said inlet means and said outlet means are formed by a single pass-box, and wherein said cleaning chamber means and said distillation column means are continuously arranged at said single pass-box.

3. The cleaning apparatus according to claim 2, wherein a dryer zone for said articles to be cleaned is arranged between said cleaning chamber means and said outlet means.

4. The cleaning apparatus according to claim 2, wherein said steam includes superheated steam.

5. The cleaning apparatus according to claim 2, wherein said cleaning chamber means is provided with a liquid cleaning tank containing said flammable solvent which soaks said articles to be cleaned.

6. The cleaning apparatus according to claim 2, wherein said cleaning chamber means is provided with a plurality of shower nozzle means for shower cleaning of said articles to be cleaned.

7. The cleaning apparatus according to claim 1, wherein said steam includes superheated steam.

8. The cleaning apparatus according to claim 1, wherein said cleaning chamber means is provided with a liquid cleaning tank means containing said flammable solvent for soaking said articles to be cleaned.

9. The cleaning apparatus according to claim 1, wherein said cleaning chamber means is provided with a plurality shower nozzle means for shower cleaning of said articles to be cleaned.

10. The cleaning apparatus according to claim 1, wherein said cleaning chamber means is provided with a liquid cleaning tank means for soaking said articles to be cleaned, and a plurality of shower nozzle means for shower cleaning of said articles to be cleaned.

11. The cleaning apparatus according to claim 1, wherein said cleaning chamber means is formed with a vapor cleaning zone and includes means for introducing steam from said distillation column means into said condenser means through said vapor cleaning zone for vapor cleaning of said articles to be cleaned.

12. The cleaning apparatus according to claim 1, wherein dryer zone for said articles to be cleaned is arranged between said cleaning chamber means and said outlet means.

13. The cleaning apparatus according to claim 12, wherein said dryer zone includes means for introducing superheated steam therein, said superheated steam acting as a dryer heat source for drying said articles to be cleaned.

14. The cleaning apparatus according to claim 13, wherein said dryer zone includes means for introducing steam into said distillation column means for concentrating said flammable solvent and for separating said water.

15. The cleaning apparatus according to claim 12, wherein said dryer zone is provided with a heater having means using at least one of steam, hot water, heated oil, and an electric heater as a dryer heat source for drying said articles to be cleaned.

16. The cleaning apparatus according to claim 12, wherein a blower means is connected to said dryer zone which does not communicate with said air outside of said cleaning apparatus, said blower means for recirculating gas through said dryer zone which is heated from outside of said cleaning apparatus.

17. The cleaning apparatus according to claim 1, wherein said distillation column means includes means for introducing stripping steam into said distillation column for concentrating said flammable solvent and for separating said water.

18. The cleaning apparatus according to claim 1, wherein a reboiler means is arranged in said distillation column means for providing a heat source to concentrate said flammable solvent and to separate said water.

19. The cleaning apparatus according to claim 1, wherein said flammable solvent is a member selected from the group consisting of methanol, ethanol, isopropyl alcohol, acetone, methyl ethyl ketone, benzene and combinations thereof, which are lower in boiling point than water, independently or in combination.

20. The cleaning apparatus according to claim 1, wherein operation of said distillation column means is carried out intermittently.

* * * * *